US010993479B2

(12) United States Patent
Blibech

(10) Patent No.: US 10,993,479 B2
(45) Date of Patent: May 4, 2021

(54) MALE UNDERGARMET SUITABLE FOR MULTIPLE WAIST SIZES

(71) Applicant: HANES OPERATIONS EUROPE SAS, Rueil-Malmaison (FR)

(72) Inventor: Ragheb Blibech, Paris (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 546 days.

(21) Appl. No.: 15/519,832

(22) PCT Filed: Oct. 14, 2015

(86) PCT No.: PCT/IB2015/057888
§ 371 (c)(1),
(2) Date: Apr. 17, 2017

(87) PCT Pub. No.: WO2016/059577
PCT Pub. Date: Apr. 21, 2016

(65) Prior Publication Data

US 2017/0238618 A1 Aug. 24, 2017

(30) Foreign Application Priority Data

Oct. 17, 2014 (FR) ..... 1460040

(51) Int. Cl.
*A41B 9/02* (2006.01)
*A41B 9/00* (2006.01)
(Continued)

(52) U.S. Cl.
CPC ..... *A41B 9/02* (2013.01); *A41B 9/004* (2013.01); *A41B 9/14* (2013.01); *A41B 2400/38* (2013.01); *A41B 2500/10* (2013.01); *A41D 7/005* (2013.01)

(58) Field of Classification Search
CPC . A41B 2400/38; A41B 2500/10; A41B 9/004; A41B 9/02; A41B 9/14;
(Continued)

(56) References Cited

U.S. PATENT DOCUMENTS 2,145,688 A * 1/1939 Flamberg ..... A41B 9/02 2/401
2,459,043 A * 1/1949 Owenby ..... A41B 9/02 2/401
(Continued)

FOREIGN PATENT DOCUMENTS

CN 1806706 A 7/2006
CN 1943459 A 4/2007
(Continued)

OTHER PUBLICATIONS

Chinese Second Office Action in Chinese Application No. 2015800563894, dated Feb. 11, 2019, 10 pages.
(Continued)

*Primary Examiner* — Robert H Muromoto, Jr.
(74) *Attorney, Agent, or Firm* — Fish & Richardson P.C.

(57) ABSTRACT

Boxer shorts (1) including a pants portion (2) made of a textile fabric, which pants portion (2) includes: A front part (3) that includes a central panel (4) intended to cover the genital organs of a wearer, and two front side parts (5*a*) (5*b*), each intended to cover at least part of the front surface of one leg of the wearer; A rear part (6) that includes a rear panel (7) intended to cover at least the majority of the buttocks of the wearer, and two rear side parts (8*a*) (8*b*), each of which is intended to cover at least part of the rear surface of one leg of the wearer; and A middle part (9) intended to cover at least one upper portion of the inner surfaces forming the crotch of the wearer; which boxer shorts (1) are noteworthy in that the rear panel (7) and the middle part (9) display at least one degree of expandability that is substantially greater than the
(Continued)

corresponding degree of expandability of the front part (3) and of the two rear side parts (8*a*) (8*b*).

17 Claims, 1 Drawing Sheet

(51) Int. Cl.
*A41B 9/14* (2006.01)
*A41D 7/00* (2006.01)

(58) Field of Classification Search
CPC .... A41B 2400/36; A41B 9/001; A41D 7/005; A41C 1/003
See application file for complete search history.

(56) References Cited

U.S. PATENT DOCUMENTS

| | | | | |
|---|---|---|---|---|
| 2,717,388 | A * | 9/1955 | Rutledge | A41B 9/02 450/118 |
| 3,835,866 | A * | 9/1974 | Brooks | A41C 1/003 450/123 |
| 2005/0120466 | A1 | 6/2005 | Coenen | |
| 2011/0023216 | A1* | 2/2011 | O'Leary | A41B 9/001 2/400 |

FOREIGN PATENT DOCUMENTS

| | | | |
|---|---|---|---|
| CN | 101331982 | A | 12/2008 |
| CN | 101686733 | A | 3/2010 |
| CN | 201898889 | U | 7/2011 |
| CN | 202949979 | U | 5/2013 |
| CN | 203243946 | A | 10/2013 |
| CN | 203538390 | U | 4/2014 |
| KR | 20030091277 | A | 12/2003 |
| RU | 2005128712 | | 5/2006 |

OTHER PUBLICATIONS

Chinese Office Action in Chinese Application No. 2015800563894, dated Sep. 4, 2018, 12 pages.
PCT International Preliminary Report on Patentability, PCT/IB2015/057888, dated Apr. 27, 2017, 7 pages.
PCT International Search Report and Written Opinion of the International Searching Authority, PCT/IB2015/057888, dated Dec. 18, 2015, 10 pages.
European Office Action in European Application No. 15784487.9, dated Sep. 28, 2018, 3 pages.
Chinese Decision for Rejection in Chinese Application No. 201580563894, dated Aug. 1, 2019, 10 pages with English translation.
Chinese Decision for Rejection in Chinese Application No. 2015800563894, dated Jan. 15, 2021, 10 pages with English Machine Translation.

* cited by examiner

MALE UNDERGARMET SUITABLE FOR MULTIPLE WAIST SIZES

The present disclosure relates to an article of knitted underclothing that corresponds to what is currently marketed under the name "boxer shorts" and which usually refers to short, close-fitting knitted underpants intended for men of all ages. It shall be understood that as used herein, the term "boxer shorts" is not limited to short underpants but also applies to long underpants, such as, for example, those known as "long boxer shorts" or "leggings".

The boxer shorts are intended to cover the lower part of the trunk and a sufficient length of the upper part of the thighs. The boxer shorts include a pants portion and a waistband located on the upper part of the pants portion, which waistband is intended to be placed around the waist of the wearer. The lower part of the pants portion is finished by two cuffs, which are intended to be positioned individually on the thighs.

Boxer shorts traditionally display a certain degree of expandability, which allows them to be cut close to the body in order to serve as a sheath for the body parts that they are intended to cover, and each pair of boxer shorts usually has a single waist size.

Boxer shorts also exist whose overall degree of expandability makes them suitable for multiple waist sizes, either through the use of a highly expandable textile fabric to which the waistband is sewn or through the use of multiple textile fabrics that have different high degrees of expandability and that are attached to each other and to the waistband. In the latter case, a first textile fabric intended to cover part of the buttocks is sewn to a second textile fabric that constitutes the rest of the boxer shorts except for the waistband. The second textile fabric usually has a so-called "standard" degree of expandability, i.e., a degree of expandability that is appropriate for boxer shorts that are suitable for a single waist size.

However, it has been found that boxer shorts that, in order to be suitable for multiple waist sizes, are made from a single stretchy textile fabric do not, in particular, provide comfortable support for the genital organs of the wearer.

Furthermore, boxer shorts that are made from two textile fabrics—the first of which textile fabrics displays a degree of expandability intended to allow the boxer shorts to be suitable for multiple waist sizes, while the second textile fabric displays a standard degree of expandability (that is, it is used solely to create the pants portion of the boxer shorts), such that the boxer shorts are suitable for only a single waist size—do not allow the wearer of the boxer shorts to move easily, because the second textile fabric, which displays a standard degree of expandability, prevents the boxer shorts from stretching sufficiently when required to do so due to the waist size of the wearer, thereby causing discomfort. Moreover, the genital organs of the wearer are poorly supported.

The present disclosure aims to eliminate the disadvantages of the prior art and, in particular, to provide boxer shorts that offer comfortable support for the genital organs of the wearer, while being suitable for wearers of different waist sizes and ensuring proper hygiene for the parts of the wearer's body that are covered by the boxer shorts.

For this purpose, the present disclosure relates to boxer shorts that include a pants portion made of a textile fabric, which pants portion includes:

A front part that includes a central panel intended to cover the genital organs of a wearer, and two front side parts, each of which is intended to cover at least part of the front surface of one leg of the wearer;

A rear part that includes a rear panel intended to cover at least the majority of the buttocks of the wearer, and two rear side parts, each of which is intended to cover at least part of the rear surface of one leg of the wearer; and A middle part intended to cover at least one upper portion of the inner surfaces forming the crotch of the wearer;

which boxer shorts are noteworthy in that the rear panel and the middle part display at least one degree of expandability that is substantially greater than the corresponding degree of expandability of the front part and of the two rear side parts.

The term "expandability" shall be understood as referring to expandability in the upward direction, i.e., in the direction of the length of the body of the wearer, and/or in the widthwise direction, i.e., in the direction of the width of the body of the wearer.

In accordance with the technical characteristics of the disclosure, taken alone or in accordance with all of the possible combinations:

The middle part includes a portion intended to cover at least part of the groin area of the wearer, with the middle part thus extending over the front part and enclosing at least part of the central panel;

The rear panel and the middle part display different degrees of expandability;

The rear panel and the middle part consist of a single piece, such that there is no junction area between them;

The rear panel and the middle part display different degrees of expandability;

The degree of expandability of the rear panel and of the middle part varies essentially continuously from one area to another of the textile fabric of which the said panel and the said part are made;

The rear panel preferably displays a degree of expandability in the upward direction that is equal to 4 to 16 times the degree of expandability in the upward direction of the front part and of the two rear side parts;

The rear panel displays a degree of expandability in the upward direction that is between 90% and 170% for a stretching stress of 15 cN;

The middle part preferably displays a degree of expandability in the upward direction that is equal to 4 to 16 times the degree of expandability in the upward direction of the front part and of the two rear side parts;

The middle part displays a degree of expandability in the upward direction that is between 90% and 170% for a stretching stress of 15 cN, and the middle part preferably displays a degree of expandability in the upward direction that is between 130% and 160% for a stretching stress of 15 cN;

The rear panel and the middle part display a degree of expandability in the widthwise direction that is equal to 1.4 to 3 times, and preferably 1.4 to 2.3 times, the degree of expandability in the widthwise direction of the front part and of the two rear side parts;

The rear panel and the middle part display a degree of expandability in the widthwise direction that is between 90% and 170% for a stretching stress of 15 cN, and the rear panel and the middle part preferably display a degree of expandability in the widthwise direction that is between 130% and 160% for a stretching stress of 15 cN;

The rear panel displays an elasticity module or modulus (i.e., springback or elastic recovery) in the upward direction that is between 90 centiNewtons (90 cN) and 300 cN for stretching of the textile fabric by more than 120% for a stretching stress of 15 cN, and the rear panel preferably displays an elasticity modulus in the upward direction that is between 100 cN and 200 cN for stretching of the textile fabric by more than 120% for a stretching stress of 15 cN;

The middle part displays an elasticity modulus in the upward direction that is between 90 cN and 300 cN for stretching of the textile fabric by more than 120% for a stretching stress of 15 cN, and the middle part preferably displays an elasticity modulus in the upward direction that is between 100 cN and 200 cN for stretching of the textile fabric by more than 120% for a stretching stress of 15 cN;

The rear panel and the middle part display an elasticity modulus in the widthwise direction that is between 90 cN and 310 cN for stretching of the textile fabric by more than 120% for a stretching stress of 15 cN, and the rear panel and the middle part preferably display an elasticity modulus in the widthwise direction that is between 100 cN and 300 cN for stretching of the textile fabric by more than 120% for a stretching stress of 15 cN;

The middle part can display only a low degree of expandability in the upward direction, and the rear panel preferably displays good degrees of expandability in both the upward direction and the widthwise direction;

The boxer shorts include a waistband located on an upper part of the pants portion, which waistband is intended to be placed around the waist of a wearer, and which waistband has a degree of expandability in the widthwise direction that is between 100% and 170% for a stretching stress of 15 cN, and the waistband preferentially displays a degree of expandability in the widthwise direction that is between 130% and 150% for a stretching stress of 15 cN;

The waistband displays an elasticity modulus in the widthwise direction that is between 450 cN and 750 cN for stretching of the textile fabric by more than 100% for a stretching stress of 15 cN, and the waistband preferably displays an elasticity modulus in the widthwise direction that is between 500 cN and 700 cN for stretching of the textile fabric by more than 100% for a stretching stress of 15 cN;

The rear panel is made from a stretchable jersey knit fabric;

The middle part is made from a stretchable jersey knit fabric;

The weight of the stretchable knit fabric is between 150 $g/m^2$ and 190 $g/m^2$, and the weight of the stretchable knit fabric is preferably 170 $g/m^2$;

The stretchable knit fabric is made from cotton and elastane;

The stretchable knit fabric consists essentially of 86% to 94% cotton and 14% to 6% elastane, respectively, and the stretchable knit fabric preferably consists essentially of 90% cotton and 10% elastane;

The front part is made from a single-knit jersey fabric;

The rear side parts are made from a single-knit jersey fabric;

The weight of the single-knit fabric is between 150 $g/m^2$ and 190 $g/m^2$, and the weight of the single-knit fabric is preferably 170 $g/m^2$;

The single-knit fabric is made from cotton and elastane;

The single-knit fabric consists of 95% to 100% cotton and 5% to 0% elastane, respectively; and the single-knit fabric preferably consists essentially of 95% cotton and 5% elastane.

In particular, the boxer shorts according to the disclosure are suitable for multiple waist sizes, while providing comfortable support for the genital organs of the wearer, allowing ease of movement by the wearer, and ensuring proper personal hygiene for the wearer's body.

In particular, the numeric values indicated hereinabove make it possible to obtain boxer shorts according to the disclosure that are suitable for at least two waist sizes.

In particular, the ranges of numeric values that are indicated as preferential make it possible to obtain boxer shorts according to the disclosure that are suitable for at least three waist sizes, while optimizing the support for the genital organs of the wearer.

In particular, the fact that the middle part encloses the central panel makes it possible to improve the support for the genital organs of the wearer, inasmuch as this design provides areas of expandability for essentially the entire extent of the genital organs of the wearer, thereby imparting to the central panel the additional amount of room or clearance that may be necessary.

In particular, the continuous change in expandability makes it possible to optimize the support provided for the various parts of the wearer's body that are covered by the more expandable regions of the boxer shorts according to the disclosure (i.e., the rear panel and the middle part), while retaining good overall expandability of the more expandable parts.

In particular, the various directions and values of the expandability of the more expandable parts allow the boxer shorts according to the disclosure to adapt to the various types of changes in the dimensions of the buttocks and thighs in particular, inasmuch as these are the areas that are most prone to changes in dimensions from one wearer to another.

We shall now describe, as a non-limitative example, one possible embodiment of the disclosure, with reference to the attached drawings, on which identical or similar reference numbers indicate identical or similar elements or sets of elements:

Figure 2:
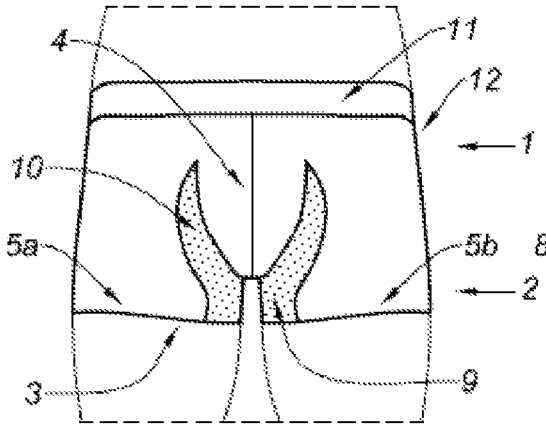
FIG. 2 is a front view of the boxer shorts according to the embodiment of the present disclosure.
Figure 1:
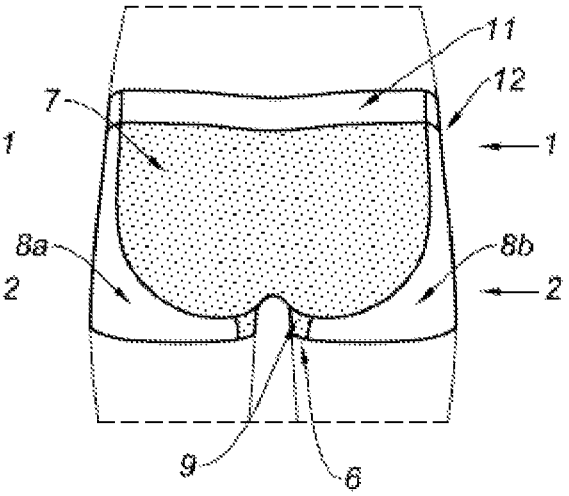
FIG. 1 is a rear view of the boxer shorts according to the embodiment of the present disclosure.

With reference now to FIG. 1 and FIG. 2, a pair of boxer shorts (1) according to the embodiment of the disclosure includes a pants portion (2) made of a textile fabric. The pants portion (2) includes:

A front part (3) that includes a central panel (4) intended to cover the genital organs of a wearer, and two front side parts (5*a*) and (5*b*), each of which is intended to cover the front surface of one leg of the wearer;

A rear part (6) that includes a rear panel (7) intended to cover the buttocks of the wearer, and two rear side parts (8*a*) and (8*b*), each of which is intended to cover the rear surface of one leg of the wearer; and A middle part (9) intended to cover the inner surfaces of the legs forming the crotch of the wearer, and including a part (10) intended to cover the groin area of the wearer, with the middle part thus extending over the front part (3) and enclosing at least part of the central panel (4).

The rear panel (7) and the middle part (9) display a degree of expandability in the upward direction and in the widthwise direction of 145% for a stretching stress of 15 cN, while the front part (3) and the two rear side parts (8*a*) and (8*b*) display a degree of expandability in the upward direction of 20% for a stretching stress of 15 cN and a degree of expandability in the widthwise direction of 80% for a stretching stress of 15 cN.

The rear panel (7) and the middle part (9) consist of a single part made from one piece of textile fabric, such that there is no junction area between them.

Furthermore, the rear panel (7) and the middle part (9) display an elasticity modulus in the upward direction and in the widthwise direction of 150 cN for stretching by 145% for a stretching stress of 15 cN, while the front part (3) and the two rear side parts (8*a*) and (8*b*) display an elasticity modulus in the upward direction and in the widthwise direction of 100 cN for stretching by 50% for a stretching stress of 15 cN.

The boxer shorts (1) include a waistband (11) located on an upper part (12) of the pants portion (2), which waistband (11) is intended to be placed around the waist of a wearer, and which waistband (11) has a degree of expandability in the widthwise direction of 145% for a stretching stress of 15 cN.

The waistband displays an elasticity modulus in the widthwise direction of 550 cN for stretching by 145% for a stretching stress of 15 cN.

In a preferred embodiment, the rear panel (7) and the middle part (9) are made from a stretchable jersey knit fabric that has a weight of 170 g/m$^2$ and that consists of 90% cotton and 10% elastane.

In a preferred embodiment, the front part and the rear side parts are made from a single-knit jersey fabric that has a weight of 170 g/m$^2$ and that consists of 95% cotton and 5% elastane.

The boxer shorts according to the disclosure are manufactured in accordance with a cut-and-sew procedure. However, they may also be manufactured in accordance with a bonding procedure in which materials are bonded together rather than being sewn together. Last, these boxer shorts can be manufactured in accordance with a so-called "seamless" or Santoni procedure, in which a product is created in the form of a single integral piece by means of Santoni-type equipment. Thanks to this procedure, the expandability of the product can be varied depending on the various areas of the product.

More specifically, FIG. 1 shows the rear part (6), as described hereinabove, of the boxer shorts according to the disclosure.

More specifically, FIG. 2 shows the front part (3) and the middle part (9), as described hereinabove, of the boxer shorts according to the disclosure.

Figure 3:
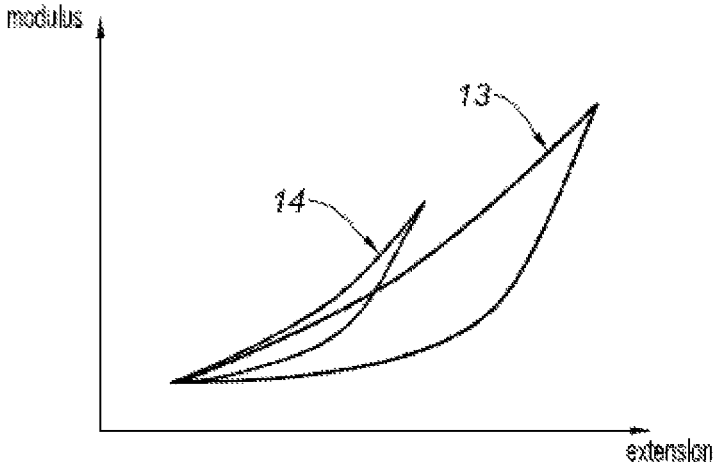
FIG. 3 shows a hysteresis curve for the waistband of a pair of boxer shorts according to the prior art and a hysteresis curve for the waistband of a pair of boxer shorts according to the present disclosure.

FIG. 3 shows, on a diagram illustrating the elasticity modulus as a function of the stretch, the difference between the hysteresis curve for a waistband according to the disclosure (for example, as described with reference to FIG. 1 and FIG. 2) (curve 13) and a known waistband according to the prior art (curve 14), showing, for example, 80% expandability for a stretching stress of 15 cN and an elasticity modulus of 800 cN for 80% expandability for a stretching stress of 15 cN.

A reading of these superimposed curves 13 and 14 reveals that the greater the expansion of the waistbands, the lower the elasticity modulus of the waistband according to the disclosure in comparison with the elasticity modulus of the waistband according to the prior art for the same expansion. It can also be seen that the waistband according to the disclosure can be stretched over a range which is broader than that of the waistband according to the prior art.

Naturally, the disclosure is not limited to the embodiment described as an example hereinabove, but also includes all of the equivalent techniques and the variants of the means described herein, as well as the possible combinations thereof.

The invention claimed is:

1. Boxer shorts comprising:

a pants portion made of textile fabric, the pants portion comprising:

a front part that includes a central panel intended to cover the genital organs of a wearer, and two front side parts, each of which is intended to cover at least part of a front surface of one leg of the wearer;

a rear part that includes a rear panel intended to cover at least the majority of the buttocks of the wearer, and two rear side parts, each of which is intended to cover at least part of a rear surface of one leg of the wearer; and a middle part intended to cover at least one upper portion of inner surfaces forming the crotch of the wearer; and a waistband located at an upper end of the pants portion and connected to the front part and the rear part;

wherein the middle part extends along a bottom edge of the central panel and further extends upwards from the bottom edge of the central panel at least partially along lateral side edges of the central panel toward the waistband to enclose at least part of the central panel;

wherein the rear panel and the middle part have a degree of expandability that is substantially greater than a degree of expandability of the front part and of the two rear side parts; and wherein the rear panel and the middle part are formed of a single piece of the textile fabric.

2. Boxer shorts according to claim 1, wherein the middle part is configured to cover at least part of the groin area of the wearer, and the middle part extends over the front part and encloses the at least part of the central panel.

3. Boxer shorts according to claim 1, wherein the rear panel and the middle part have different degrees of expandability.

4. Boxer shorts according to claim 1, wherein the rear panel and the middle part each have multiple degrees of expandability.

5. Boxer shorts according to claim 1, wherein the degree of expandability of the rear panel and of the middle part varies continuously from one area to another area of the textile fabric of which the rear panel and the middle part are made.

6. Boxer shorts according to claim 1, wherein a degree of expandability in an upward direction of the rear panel is 4 to 16 times the degree of expandability in the upward direction of the front part and of the two rear side parts.

7. Boxer shorts according to claim 1, wherein a degree of expandability in the upward direction of the middle part is 4 to 16 times the degree of expandability in the upward direction of the front part and of the two rear side parts.

8. Boxer shorts according to claim 1, wherein a degree of expandability in the widthwise direction of the rear panel and the middle part is 1.4 to 3 times the degree of expandability in the widthwise direction of the front part and of the two rear side parts.

9. Boxer shorts according to claim 1, wherein an elasticity modulus of the rear panel in the upward direction is between 90 cN and 300 cN for stretching of the textile fabric by more than 120% for a stretching stress of 15 cN.

10. Boxer shorts according to claim 1, wherein an elasticity modulus of the middle part in the upward direction is between 90 cN and 300 cN for stretching of the textile fabric by more than 120% for a stretching stress of 15 cN.

11. Boxer shorts according to claim 1, wherein the rear panel and the middle part have an elasticity modulus in the widthwise direction that is between 90 cN and 310 cN for stretching of the textile fabric by more than 120% for a stretching stress of 15 cN.

12. Boxer shorts according to claim 1, wherein the waistband intended to be placed around the waist of a wearer, and the waistband having a degree of expandability in the widthwise direction between 100% and 170% for a stretching stress of 15 cN.

13. Boxer shorts according to claim 12, wherein the waistband has an elasticity modulus in the widthwise direction that is between 490 cN and 710 cN for stretching of the textile fabric by more than 100% for a stretching stress of 15 cN.

14. Boxer shorts according to claim 2, wherein the rear panel and the middle part have different degrees of expandability.

15. Boxer shorts according to claim 8 wherein a degree of expandability in the widthwise direction of the rear panel and the middle part is 1.4 to 2.3 times the degree of expandability in the widthwise direction of the front part and of the two rear side parts.

16. Boxer shorts according to claim 1, wherein the waistband is configured to be placed around the waist of a wearer, and the central panel of the front part comprising an upper edge along the waistband.

17. Boxer shorts according to claim 1, wherein the middle part that extends upwards at least partially along lateral side edges of the central panel is disposed between the central panel and the two front side parts of the front part.

* * * * *